US008231362B2

(12) United States Patent
Winkler

(10) Patent No.: US 8,231,362 B2
(45) Date of Patent: Jul. 31, 2012

(54) MULTI-CHAMBERED PUMP

(75) Inventor: Gary Eugene Winkler, St. Louis, MO (US)

(73) Assignee: Innoventor Renewable Power, Inc., St. Louis, MO (US)

( * ) Notice: Subject to any disclaimer, the term of this patent is extended or adjusted under 35 U.S.C. 154(b) by 714 days.

(21) Appl. No.: 12/368,724

(22) Filed: Feb. 10, 2009

(65) Prior Publication Data

US 2010/0202895 A1 Aug. 12, 2010

(51) Int. Cl.
*F04B 17/00* (2006.01)

(52) U.S. Cl. ..... 417/342; 417/53; 417/403; 417/521

(58) Field of Classification Search ..... 417/20, 417/53, 63, 317, 342, 347, 401, 403, 515–519, 417/521, 900; 222/255; 60/431–434; 313/382, 313/385, 390, 393
See application file for complete search history.

(56) References Cited

U.S. PATENT DOCUMENTS 3,234,882 A * 2/1966 Douglas et al. ..... 417/53
3,829,254 A 8/1974 Stetter et al.
3,908,865 A 9/1975 Day
4,105,373 A 8/1978 Calzolari
4,191,513 A 3/1980 Schwing
4,193,873 A 3/1980 Thrasher
4,625,513 A 12/1986 Glomeau
4,790,728 A 12/1988 Dwyer
5,263,828 A 11/1993 Schwing et al.
5,332,366 A 7/1994 Anderson
5,336,052 A 8/1994 Zollner et al.
5,507,624 A 4/1996 Fehn
5,993,181 A 11/1999 Hudelmaier
2002/0071771 A1* 6/2002 Miller ..... 417/285
* cited by examiner

*Primary Examiner* — Mariceli Santiago
*Assistant Examiner* — Donald Raleigh
(74) *Attorney, Agent, or Firm* — Armstrong Teasdale LLP

(57) ABSTRACT

A multi-chambered pumping system is provided comprising an input cylinder configured to pump a source substance into a vessel and an effluent cylinder configured to receive an effluent from the vessel. The cylinders regulate the pressure of the source substance input into the vessel and recover the pressure of an effluent output from the vessel to pump additional quantities of source substance into the vessel. In each cylinder, a piston creates a boundary between two sections: a fluid section configured to receive working fluid and an effluent or input process section to receive the same. The fluid sections of the cylinders are in fluid communication. A guide rod is attached to each piston and may be operably sized to compensate for a pressure difference between a pressure at which the source substance is pumped into a vessel and the pressure at which an effluent is output from the vessel.

22 Claims, 4 Drawing Sheets

MULTI-CHAMBERED PUMP

BACKGROUND OF THE INVENTION

The field of the invention relates generally to multi-chambered pumps and methods of operating the same, and more specifically, to a multi-chambered pump for pumping a source substance into a vessel and harnessing the pressure associated with an effluent output from the vessel to aid in pumping additional quantities of the substance into the vessel.

While reference is made herein to source substances comprising slurries and multi-chambered pumps referred to as slurry pumps, these examples should not be construed as limiting the scope of the embodiments. Rather, the systems and methods described herein are applicable to a wide range of substances and multi-chambered pumps.

A slurry (i.e., a source substance) is a watery mixture of insoluble matter. Examples of slurries include: mud, lime, unset plaster of paris, and mixtures of manure and other liquids. In some refining operations, slurries are pumped into a vessel (e.g., a process reactor) where a chemical reaction transforms the slurry into a chemically different composition (i.e., an effluent). The chemical reaction that takes place in the process reactor often requires the slurry to be input at an elevated pressure (e.g., 100 atmospheres), and likewise results in the effluent being expelled from the process reactor at a pressure slightly lower than it was input.

The utilization of traditional slurry pumps (e.g., piston-type reciprocating pumps) to pump the slurry into the process reactor requires the use of valves (typically check valves) to maintain the elevated pressure within the process reactor during the different phases of the pumping cycle. The valves control both the inlet and outlets of the process reactor to maintain an elevated pressure therein during a pumping cycle of the piston-type reciprocating pumps. The valves are not capable of reliably controlling the high-pressure flow of the slurry due to the solids suspended therein. The solids erode the seals and seats within a valve, often leading to premature failure of the valve. Additionally, the valves can be prevented from fully closing if a piece of the solid becomes lodged between a valve member and its corresponding seat.

Due to the closed system design of certain process reactors, effluent is expelled from the process reactor at an elevated pressure, although it is often slightly less than the pressure at which the slurry was input to the process reactor due to, for example, frictional losses within the process reactor. Generally, the energy contained in the elevated pressure effluent flow has not been harnessed, as the effluent is simply discharged to a holding tank or other receptacle. Further, as the effluent may still contain solids disposed therein, the same problems are encountered in metering the flow with valves as those experienced in metering the input of slurry.

Accordingly, an improved pumping system and method are needed to reliably control the input and output of slurry from a process reactor at an elevated pressure and harness the elevated pressure of the effluent flow to aid in the pumping of additional slurry into the process reactor.

BRIEF DESCRIPTION OF THE INVENTION

According to one embodiment, a multi-chambered pump is provided that includes an input portion and an effluent portion. The input portion comprises an input cylinder having an inner diameter and an input piston positioned therein with an input cylinder guide rod attached thereto. The input cylinder guide rod has a first diameter. The input piston and input cylinder guide rod are operable to pump a source substance. The effluent portion comprises an effluent cylinder having an inner diameter and an effluent piston positioned therein with an effluent cylinder guide rod attached thereto. The effluent piston and effluent cylinder guide rod are operable to pump an effluent. The inner diameter of the input cylinder and the inner diameter of the effluent cylinder are substantially equal and a portion of each cylinder is in fluid communication with the other.

According to another embodiment, a system for pumping both a source substance and an effluent is provided that includes a process reactor, an input portion, and an effluent portion. The process reactor is configured to receive a source substance as input to a process and generate an effluent as output from the process. The input portion comprises an input cylinder having an inner diameter and input piston positioned therein and separating an input process section from a fluid section. An input cylinder guide rod is attached to the input piston, and the guide rod has a first diameter. The input piston and input cylinder guide rod are operable to pump a source substance. An effluent portion comprises an effluent cylinder having an inner diameter and an effluent piston positioned therein and separating an effluent process section from a fluid section. An effluent cylinder guide rod is attached to the effluent piston. The effluent cylinder guide rod has a second diameter that is different from the first diameter associated with the input cylinder guide rod. The effluent piston and effluent cylinder guide rod are operable to pump an effluent. The inner diameter of the input cylinder and the inner diameter of the effluent cylinder are substantially equal and a portion of each cylinder is in fluid communication with the other. The difference between the first diameter associated with the input cylinder guide rod and the second diameter associated with the effluent cylinder guide rod is operable to compensate for a pressure difference between a pressure associated with input into a process reactor from the input cylinder and a pressure associated with an effluent contained within the process reactor and output to the effluent cylinder. One or more valves permit the selective transfer of fluid between at least a portion of each of the input cylinder and effluent cylinder.

A method of pumping a source substance into a process reactor and receiving an effluent as output from the process is provided in accordance with another embodiment. The method begins with receiving the source substance into an input process section of an input cylinder and simultaneously discharging effluent from an effluent process section of an effluent cylinder. The input process section of the input cylinder is configured to receive the source substance and an input piston separates the input process section from a fluid section configured to receive a working fluid. The effluent process section of the effluent cylinder is configured to receive the effluent discharged from the process reactor and a piston separates the effluent process section from a fluid section configured to receive a working fluid. The fluid sections of the effluent and input cylinders are in fluid communication with each other. The method continues with the discharging of the source substance from the input process section of the input cylinder into the process reactor and simultaneously receiving effluent into the effluent process section of the effluent cylinder at an elevated pressure from the process reactor. Working fluid is directed from the fluid section of the effluent cylinder to the fluid section of the input cylinder to act against the input piston and expel the source substance from the input process section, thereby reducing the amount of working fluid required to be supplied by an external source.

DETAILED DESCRIPTION OF THE INVENTION

Figure 1:
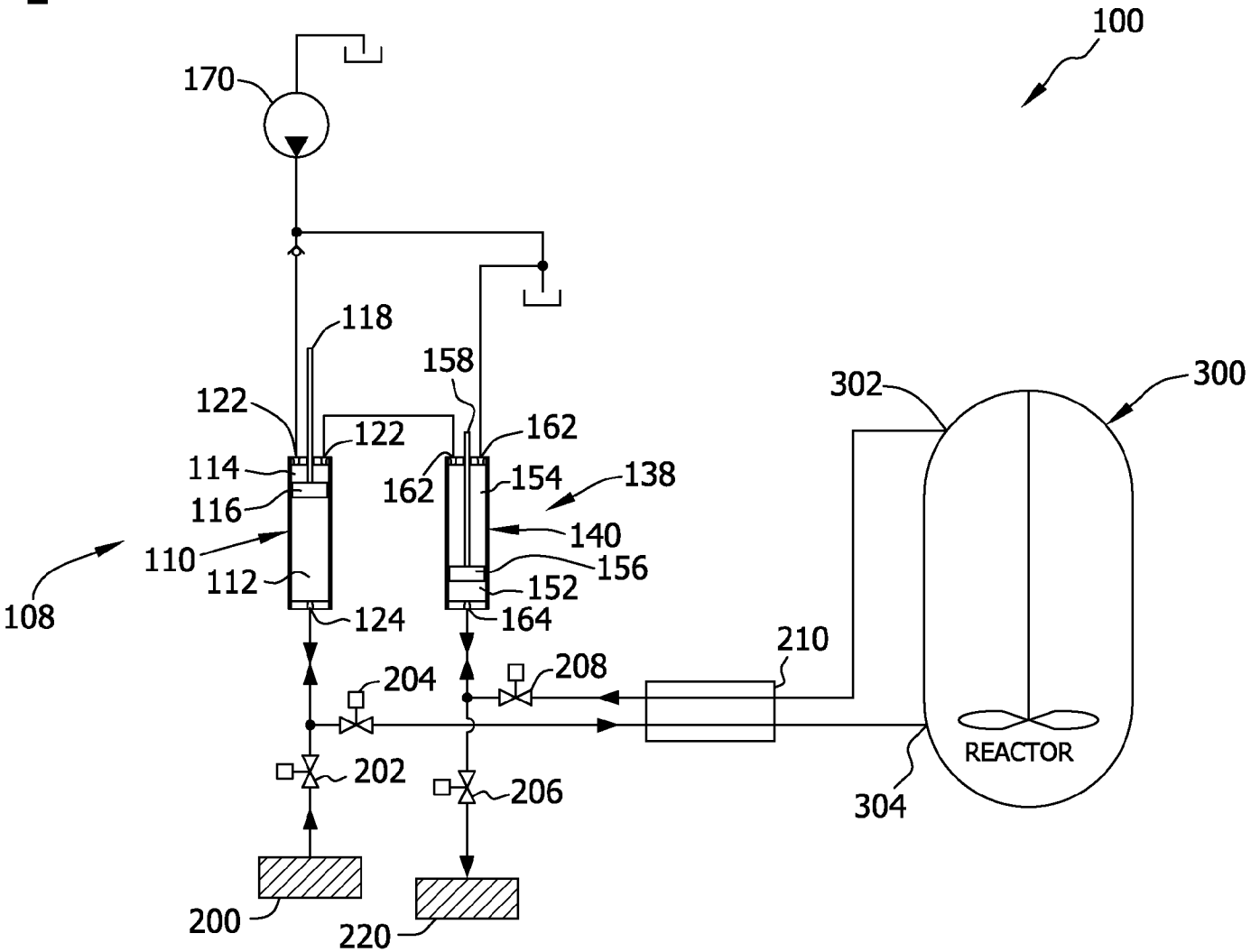
FIG. 1 is a schematic view of a multi-chambered pumping system in accordance with one embodiment of the present invention.

The disclosed embodiments define a pump, systems, and methods for pumping a source substance (e.g., a slurry) into a vessel (e.g., a process reactor) and receiving an effluent as output from the vessel. While reference is made herein to examples of substances such as slurries, such reference is not intended to limit the scope of the embodiments. The disclosed embodiments are applicable to a variety of substances which are primarily liquid in composition or mixtures of liquids and solids.

The disclosed embodiments also provide a mechanism for utilizing the pressure of the effluent output from the process reactor to aid in pumping additional source substance into the process reactor, while controlling the flow of effluent out of the process reactor. A dual-cylinder pump arrangement is provided wherein a first portion (i.e., an input portion) pumps source substance into the process reactor and a second portion (i.e., an effluent portion) receives the effluent output from the process reactor. The effluent portion controls and maintains the pressure of the flow of effluent output from the process reactor, thus removing the need for an output pressure control valve, as utilized in at least some known systems.

The source substance is input into the process reactor at an elevated pressure by an input portion of the pump. An effluent portion of the pump receives an effluent that is output from the process reactor. The effluent is output from the process reactor at elevated pressure that is slightly below that at which the source substance was input to the process reactor. Both the input and effluent portions of the pump comprise a process section for receiving the source substance or effluent, respectively. A piston separates the effluent or input process section from a working fluid contained in respective fluid sections. Attached to each piston is a guide rod.

The fluid sections of the input and effluent portion are in fluid communication with each other. The elevated pressure at which the effluent is received into the effluent portion of the pump is harnessed to aid in the pumping of additional source substance into the process reactor by selectively directing working fluid from the fluid section of the effluent portion to the fluid section of the input portion. The difference in pressure associated with the input of source substance into the process reactor and that associated with the effluent output from the process reactor is compensated for by a difference in diameters between the guide rods attached to the pistons.

While specific mention is made herein to use of a pumping system involving a process reactor, different embodiments of the invention are suitable for other applications. Any application that requires the pumping of a medium into a system and the receiving of a medium as output from the system are suitable applications for the embodiments described herein. Additionally, the embodiments described herein provide systems and methods for controlling the flow and associated pressure of a source substance using a plurality of cylinders, without solely relying on valves. Accordingly, the embodiments may be utilized in a variety of applications that require the control of a flow of source substance or other substance.

Referring initially to FIG. 1, a schematic view of a multi-chambered pumping system (referred to generally as 100) is presented in accordance with one embodiment of the present invention. Included in the multi-chambered pumping system 100 are a source substance tank 200 and an effluent vat 220. Both the source substance tank 200 and the effluent vat 220 may be open to the atmosphere and consequently at or near atmospheric pressure, or they may be enclosed and maintained at another suitable pressure. In some embodiments, the source substance tank 200 may be positioned such that source substance is able to drain from the source substance source and into other portions of the multi-chambered pumping system 100 with only the aid of gravity. In one embodiment, pumps or conveyors may also be used in addition to or instead of gravity to transport the source substance from the source substance tank 200. As used herein, the term "transport" is utilized to describe methods for moving mass from one location to another, including, but not limited to: pumping, gravity, auger, conveyor, and the like.

The source substance deposited in the source substance tank 200 can take many forms, according to different embodiments. In some embodiments, the source substance is a slurry having a composition of insoluble solids dispersed in a liquid. Examples of slurries include: mud, lime, unset plaster of paris, mixtures of organic matter (e.g., plants) and liquids, and mixtures of manure or animal waste and other liquids. One type of slurry (e.g., mixtures of manure or animal waste and other liquids) serves as a feedstock to process conducted in a process reactor 300. The process may involve a combination of elevated pressure or temperature to alter the chemical structure of the slurry, resulting in an effluent as an output. In the embodiments discussed herein, the process performed in the process reactor 300 is a closed system process, in which material is neither added nor removed during the process. Other embodiments may utilize different processes that involve the addition or removal of material during the process without departing from the scope of the embodiments.

In some embodiments, the source substance is a composition of animal waste (e.g., feces and urine) and other liquids (e.g., water). In these embodiments, the effluent may comprise a variety of components, some of which may be forms of hydrocarbons that are suitable for use as fuel or substitutes or additives to petroleum-based products. For a fuller explanation of the conversion of animal waste into a useable form, see U.S. Pat. No. 7,105,088 to Schein et al., entitled "Methods and Systems for Converting Waste into Energy", the entirety of the disclosure of which is incorporated herein by reference.

Figure 2:
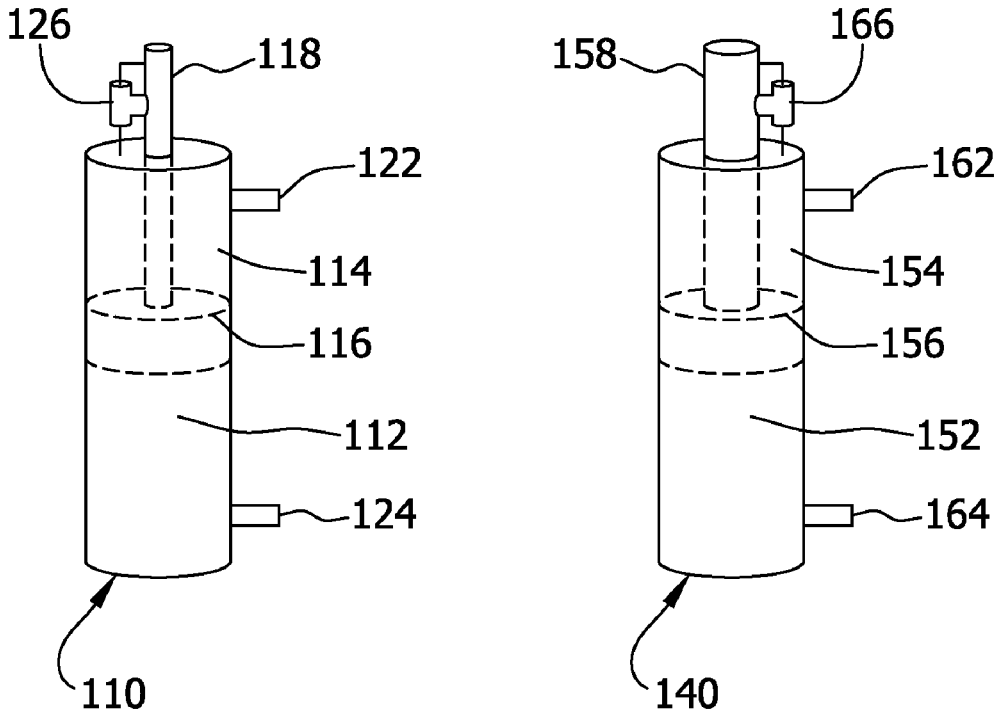
FIG. 2 is a side view of an input portion and an effluent portion of a pump in accordance with another embodiment of the present invention.

As seen in FIGS. 1 and 2, the pump system 100 includes an input portion 108 and an effluent portion 138. The input portion 108 includes an input cylinder 110 having an inner diameter. Source substance input valve 202 controls the flow of source substance from the source substance tank 200 into a input process section 112 of the input cylinder 110 through an input cylinder input port 124. An input piston 116 separates the input process section 112 from a fluid section 114. Attached to the input piston 116 is an input cylinder guide rod 118. The input cylinder guide rod 118 extends through a portion of the fluid section 114 and has a first diameter associated therewith. Working fluid enters and exits the fluid section 114 of the input cylinder 110 through inlet and exhaust ports 122.

As the input piston 116 moves along a longitudinal axis of the input cylinder 110, the volumes of the input process section 112 and fluid section 114 change in volume in inverse relation to one another. Source substance will flow into the input process section 112 (provided a supply of source substance is available from the source substance tank 200) when the pressure of the working fluid is less than the pressure of the source substance. Conversely, source substance will flow out of the input process section 112 (provided a fluid communication means is available) when the pressure of the source substance is less than the pressure of the working fluid in the fluid section 114. The longitudinal position of the input cylinder guide rod 118 relative to a fixed point can be measured and monitored in some embodiments by an input cylinder LVDT (linear variable differential transducer) 126. In other embodiments, different mechanisms (e.g., string pots) may be used to monitor the linear position of the input cylinder guide 118.

Seals or rings (not shown) may surround the input piston 116 and prevent source substance or working fluid from coming into contact with each other as the piston moves along the longitudinal axis of the input cylinder 110. Additionally the components comprising the input portion 108 of the pump system 100 may be formed from any number of suitable materials (e.g., metal).

The effluent portion 138 of the pump system 100 includes an effluent cylinder 140 having an inner diameter. In some embodiments, the inner diameter of the effluent cylinder 140 and the input cylinder 110 are substantially equal, while in other embodiments they may differ by a small amount, (e.g. less than a tenth or quarter of an inch). Effluent enters and exits an effluent process section 152 of the effluent cylinder 140 through an effluent cylinder input port 164. An effluent piston 156 separates the effluent section from a fluid section 154. Attached to the effluent piston 156 is an effluent cylinder guide rod 158. The effluent cylinder guide rod 158 extends through a portion of the fluid section 154 and has a second diameter associated therewith. Working fluid enters and exits the fluid section 154 of the effluent cylinder through inlet and exhaust ports 162.

The longitudinal position of the effluent cylinder guide rod 158 relative to a fixed point can be measured and monitored in some embodiments by an input cylinder LVDT (linear variable differential transducer) 166. In other embodiments, different mechanisms (e.g., string pots) may be used to monitor the linear position of the effluent cylinder guide 158.

Seals or rings (not shown) may surround the effluent piston 156 and prevent effluent or working fluid from coming into contact with each other as the piston moves along the longitudinal axis of the effluent cylinder 140. Additionally the components comprising the effluent portion 138 of the pump system 100 may be formed from any number of suitable materials (e.g., metal).

Connecting the fluid sections 114 and 154 of the input cylinder 110 and the effluent cylinder 140 are fluid connection components (e.g., piping or hoses) that provide fluid communication between the fluid sections 114 and 154. One or more valves (not shown) control the flow of working fluid between the fluid sections 114 and 154 and a working fluid pump 170 and associated reservoir (not shown). As discussed in greater detail below, the pressure associated with output of effluent from the process reactor 300 is utilized to transfer working fluid between the fluid sections 114 and 154 in order to reduce the amount of working fluid that is provided by the working fluid pump 170 to pump source substance from the input cylinder 110 into process reactor 300. The utilization of the pressure of the effluent to aid in pumping source substance into the process reactor significantly reduces the power consumption of the working fluid pump 170.

Returning now to the pumping system 100, source substance exit valve 204 controls the flow of source substance from the input process section 112. Upon closing of the source substance input valve 202 and opening of the source substance exit valve 204, source substance can travel through various pipes or other fluid communication systems to an input 304 of the process reactor 300. The source substance then travels through the process reactor 300 before exiting as effluent at an output 302 of the process reactor. Once inside the process reactor 300, the source substance may be subjected to elevated temperature or pressure for some duration and converted to the above mentioned effluent. The chemical composition of the source substance is changed before exiting the process reactor, thus resulting in an effluent having a different composition than the source substance input to the process reactor 300. In some embodiments, the effluent may contain a plurality of components, such as a solid immersed in water or other liquid. Subsequent processes (not shown) may be used to separate the components of the effluent.

An effluent exit valve 208 controls the flow of effluent from the process reactor through the output 302 therein to an effluent inlet port 164 to the effluent process section 152 of the effluent cylinder 140. Upon opening of the effluent exit valve 208 and closing of an effluent dump valve 206, effluent is able to flow from the process reactor 300 to the effluent process section 152, thus raising the effluent piston 156 and displacing working fluid from the fluid section 154 of the effluent cylinder 140.

The amount of heat required to be input to the process reactor 300 is reduced through the use of a heat exchanger 210. In some embodiments, the source substance passes through the heat exchanger 210 before entering the process reactor 300. Effluent subsequently passes through the heat exchanger after exiting the process reactor 300. The heat exchanger 210 transfers heat from the effluent exiting the process reactor 300 to the source substance entering the process reactor, thus reducing the amount of heat that the process reactor must provide to the source substance.

Figure 3:
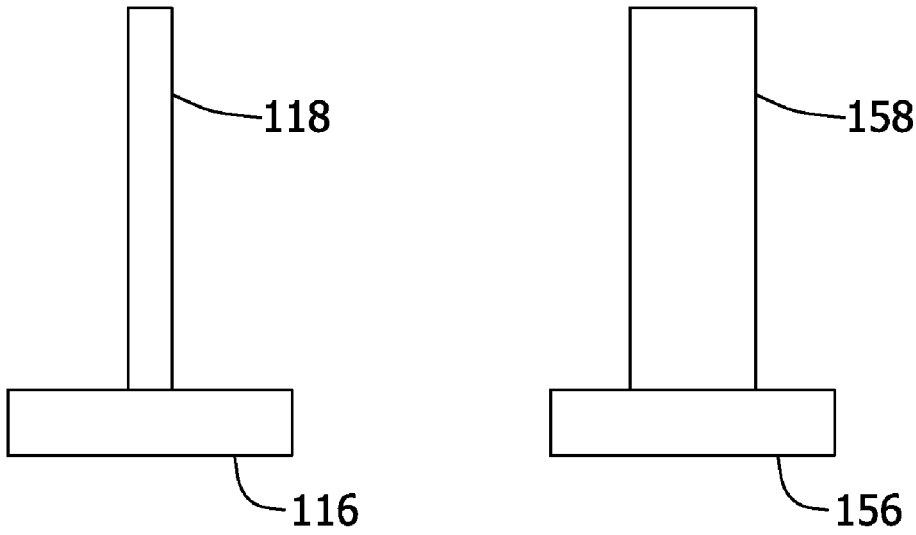
FIG. 3 is a side view of an input cylinder guide rod and piston and an effluent cylinder guide rod and piston, in accordance with an embodiment of the present invention.
Figure 4:
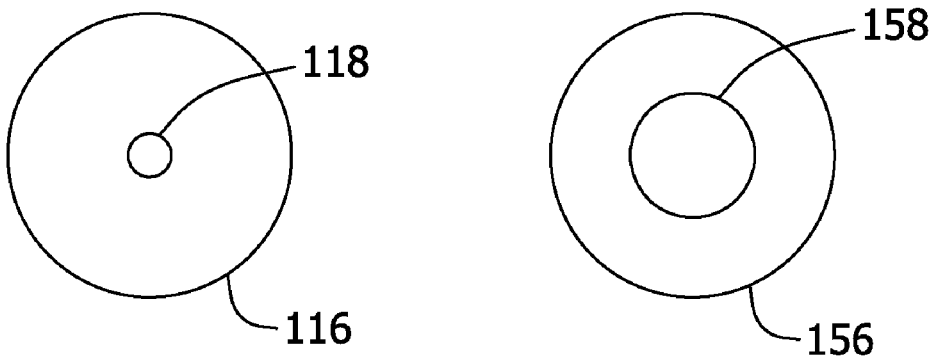
FIG. 4 is a top view of the input cylinder guide rod and piston and the effluent cylinder guide rod and piston, in accordance with an embodiment of the present invention.

As best seen in FIGS. 3 and 4, the first diameter associated with input cylinder guide rod 118 is less than that of the second diameter associated with the effluent cylinder guide rod 158. The difference in diameters between the guide rods 118 and 158 serves to compensate for a pressure difference between a pressure associated with a source substance input into the process reactor 300 from the input cylinder 110 and a pressure associated with the effluent contained within the process reactor and output to the effluent cylinder 140. According to other embodiments, the first diameter associated with the input cylinder guide rod 118 is substantially equal to that of the second diameter associated with the effluent cylinder guide rod 158 and additional pressurized working fluid is provided by working fluid pump 170.

Figure 5:
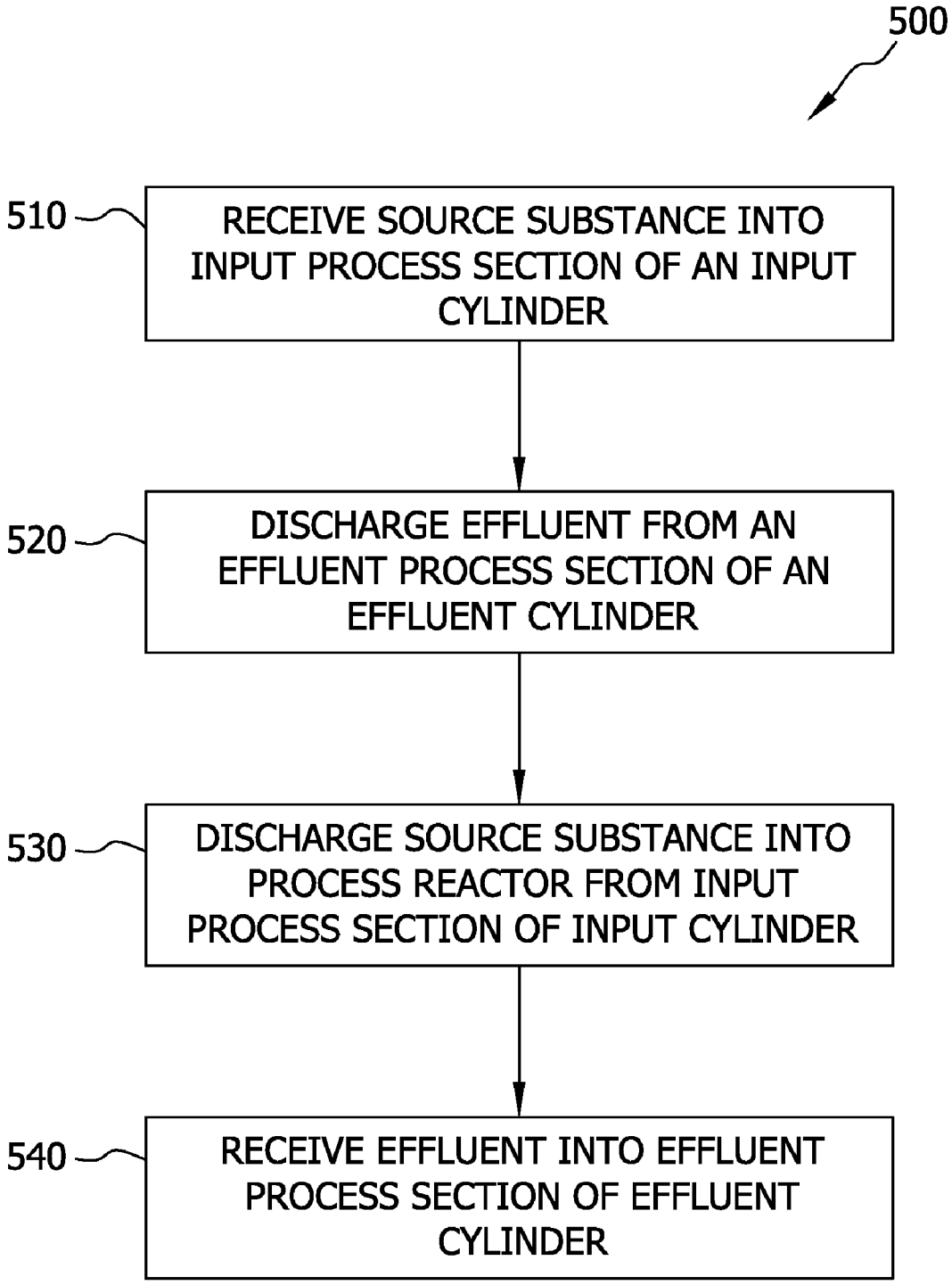
FIG. 5 is a flow diagram depicting a method of pumping a slurry into a process reactor and receiving an effluent as output from the process reactor, in accordance with another embodiment of the present invention.

Referring now to FIG. 5, a flow diagram 500 is provided that illustrates a method for pumping a source substance (e.g., a slurry) into a process reactor and receiving an effluent as output from the process reactor, in accordance with another embodiment. In operation of the pumping system, there are two distinct cycles. A first cycle includes receiving 510 source substance into an input process section of the input cylinder and a corresponding discharging 520 of effluent from an effluent process section of the effluent cylinder. The second cycle includes discharging 530 of source substance from the input process section of the input cylinder into the process reactor and corresponding receiving 540 of the effluent in the effluent process section of the effluent cylinder from the process reactor. Accordingly, while the steps depicted in blocks 510 and 520 are depicted as separate operations, they occur substantially simultaneously and may be performed simultaneously. Likewise, the steps depicted in blocks 530 and 540 occur substantially simultaneously and may accordingly be performed as such.

For purposes of discussion herein, it will be assumed that the process reactor is acting in a steady-state operation wherein the source substance level within the process reactor is at its operating capacity. During initial startup of the pump system when the process reactor is substantially empty or the source substance level is below operating capacity, multiple pumping operations by the input cylinder alone (e.g., without corresponding withdrawal of effluent from the process reactor) may be required to "charge" the process reactor with source substance. In some embodiments, the pumping operation may cease after the charging of the process reactor is complete to allow the process reactor the requisite time to change the chemical composition of the source substance into the effluent. Further, it is assumed that the method described below, which begins with the filing of the input cylinder, that the effluent cylinder has already been filled with effluent output from the process reactor.

The method depicted in FIG. 5 begins with the receiving 510 of source substance into the input process section of the input cylinder. The source substance may be conveyed into the input process section by the force of gravity, wherein a source of the source substance is positioned above the input to the input process section. In other embodiments, different conveying mechanisms may be used to feed source substance into the input process section, such as augers or conveyers. One or more valves may control the flow of source substance into the input process section, and accordingly are opened to permit the flow source substance into the input process section. After the input process section has been filled with source substance, the one or more valves are closed.

Effluent is discharged 520 from the effluent process section of the effluent cylinder into an effluent vat in fluid communication therewith. To discharge effluent from the vat, one or more valves controlling the output from the effluent process section of the effluent cylinder are opened, thus permitting the effluent to travel to the effluent vat through any suitable fluid connection components (e.g., pipes, hoses, troughs, etc.). The effluent is then subjected to additional processes (e.g., separation or drying operations).

As effluent is discharged from the effluent process section, the effluent cylinder piston travels along the longitudinal axis of the effluent cylinder, thus reducing the volume of the effluent process section and increasing the volume of the fluid section. Additional working fluid is directed into the fluid section from the input cylinder's fluid section as the input process section of the input cylinder is filled with source substance. One or more valves may control the flow of working fluid between the fluid sections of the input and effluent cylinders. After the effluent has discharged from the effluent process section, the one or more valves controlling the output from the effluent process section are closed.

The source substance is pumped or discharged 530 into the process reactor from the input process section of the input cylinder. Coincident with the initiation of pumping the source substance into the process reactor, a valve controlling the flow of source substance along a pipe or hose into the process reactor is opened. To pump the source substance from the input process section, working fluid in the fluid section acts against the input piston, thus forcing it to move along the longitudinal axis of the input cylinder. When the pressure of the working fluid in the fluid sections exceeds that of the source substance in the input process section, the volume of the input process section begins to decrease as the working fluid moves the input piston.

In some embodiments, the source substance is input into the process reactor at an elevated pressure, and accordingly is pumped at this elevated pressure into the process reactor. A guide rod is attached to the input piston and extends through the fluid section thus reducing the surface area of the input piston on which the working fluid is able to act. Accordingly, the pressure of the working fluid exceeds the pressure of the source substance being pumped out of the input process section. Working fluid is supplied to the fluid section of the input cylinder from the fluid section of the effluent cylinder, as described in greater detail below. Working fluid is also provided by the working fluid pump. In embodiments that utilize hydraulic fluid as a working fluid, the working fluid pump is a hydraulic pump.

Effluent is received 540 into the effluent process section of the effluent cylinder from the process reactor. As described above, effluent is output from the process reactor at an elevated pressure, often slightly less than that of source substance input into the process reactor. The decrease in pressure is a result of numerous factors including, but not limited to: frictional losses in the process reactor or chemical changes occurring in the source substance.

In order to receive effluent into the effluent process section, one or more valves are opened that control the flow of effluent into the effluent process section. In some embodiments, the flow of effluent from the process reactor to the effluent process reaction is effectuated by one or more pipes, hoses, or tubes.

One or more valves controlling the flow of working fluid into and out of the fluid section of the effluent cylinder may be opened. As the effluent fills the effluent process section, it acts against the effluent piston, which in turn acts against the working fluid. The guide rod attached to effluent piston extends through the fluid section, thus reducing the surface area of the piston adjacent to the fluid section. Accordingly, when the effluent acts against one side of the piston, the pressure associated with the working fluid on the other side of the piston is greater than the pressure of the effluent. In hydraulic systems, this concept is sometimes referred to as pressure amplification. As the pressure is determined by the force applied divided by the surface area of the piston, a larger guide rod reduces the surface area of the piston and increases the pressure amplification.

In some embodiments, the inner diameter of the input and effluent cylinders are substantially equal and the effluent cylinder guide rod has a larger diameter than the input cylinder guide rod. Accordingly, when the effluent acts upon the effluent piston, the pressure of the working fluid in the corresponding fluid section is greater than the pressure associated with the effluent. As effluent fills the effluent process section and acts against the piston, working fluid is directed from the fluid section via one or more pipes or hoses to the fluid section of the input cylinder.

As described above, the diameters of the input cylinder guide rod and the effluent cylinder guide are operable to compensate for the difference in pressure of the source substance input into the process reactor and effluent output from the process reactor. The difference in diameters between the guide rods are sized to amplify the pressure of the working fluid in the fluid section of the effluent cylinder to the pressure required in the fluid section of the input cylinder to pump source substance into the process reactor at the desired pressure. To accomplish this, the diameter of the effluent cylinder guide rod is larger than the input cylinder guide rod. In other embodiments, the diameters of the effluent cylinder guide rod and the input cylinder guide rod are substantially equal. In these embodiments, additional pressurized working fluid is supplied to account for the pressure differential between the effluent output from the process reactor and the source material input to the process reactor.

As the diameter of the effluent cylinder guide rod is larger than the input cylinder guide rod in some embodiments, the amount of working fluid directed from the fluid section of the effluent cylinder to the fluid section of the input cylinder is less than that required to pump the source substance. Accordingly, additional working fluid is supplied by the working fluid pump and associated reservoir when source substance is pumped from the input cylinder and effluent is simultaneously received in the effluent cylinder. The volume of the additional working fluid required is approximately equal to the difference in volume between the two fluid sections caused by the differently sized guide rods. However, in some embodiments the diameters of the guide rods are substantially equal and accordingly additional pressurized working fluid is required over that required for the other described embodiment.

In the other phase of the pumping cycle, discussed in relation to receiving 510 and discharging 520, working fluid is directed from the fluid section of the input cylinder to the fluid section of the effluent cylinder. As the fluid section in the effluent cylinder is lesser in volume than that of the input cylinder fluid section, the excess working fluid is directed to a reservoir. Upon initiation of the other phase of the pumping cycle, the working fluid pump uses working fluid contained in the reservoir.

In some embodiments, the heat exchanger described above may be utilized. The heat exchanger transfers heat between the effluent output from the process reactor and the source substance input to the process reactor. Accordingly, source substance passes through the heat exchanger before entering the process reactor and effluent passes through the heat exchanger after exiting the process reactor. The heat exchanger is useful in embodiments wherein the source substance is subjected to an elevated temperature in the process reactor, and effluent is subsequently output from the process reactor at an elevated temperature. The utilization of the heat exchanger permits a portion of the heat associated with the effluent to be transferred to the source substance, thus reducing the amount of heat required for operation of the process reactor.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A pump comprising:

an input portion comprising an input cylinder having an inner diameter, an input piston positioned within said input cylinder, and an input cylinder guide rod attached to said piston, said input cylinder guide rod having a first diameter, wherein said input piston and said input cylinder guide rod are operable to pump a source substance;

an effluent portion comprising an effluent cylinder having an inner diameter, an effluent piston positioned within said effluent cylinder, and an effluent cylinder guide rod attached to said effluent piston, said effluent cylinder guide rod having a second diameter, wherein said effluent piston and said effluent cylinder guide rod are operable to pump an effluent, wherein:

the inner diameter of said input cylinder and the inner diameter of said effluent cylinder are substantially equal and at least a portion of each of said input cylinder and said effluent cylinder are in fluid communication with each other;

wherein a difference between the first diameter associated with said input cylinder guide rod and the second diameter associated with said effluent cylinder guide rod is operable to compensate for a pressure difference between a pressure associated with a source substance input into said input cylinder and a pressure associated with an effluent output to said effluent cylinder;

wherein the input cylinder and the effluent cylinder each comprise a fluid section, said fluid sections in fluid communication with one another; and wherein the input cylinder guide rod is disposed through at least a portion of the fluid section of the input cylinder and the effluent cylinder guide rod is disposed through at least a portion of the fluid section.

2. The pump of claim 1 wherein the fluid section and an input process section of the input cylinder are separated by the input piston, and wherein the fluid section and an effluent process section of the effluent cylinder are separated by the effluent piston.

3. The pump of claim 2 wherein the fluid sections of the effluent and input cylinders are operable to a receive a working fluid, said working fluid in contact with a surface of the input cylinder piston and the effluent cylinder piston.

4. The pump of claim 3 wherein the second diameter associated with the effluent cylinder guide rod is greater than that of the first diameter associated with the input cylinder guide rod, thereby resulting in the effluent cylinder piston having a smaller surface area in contact with the working fluid contained in the fluid section of the effluent cylinder than the surface area of the input cylinder piston upon which the working fluid acts.

5. The pump of claim 4 wherein the source substance is pumped from the input cylinder at a first pressure and effluent is received at a second pressure, wherein the second pressure is less than the first pressure.

6. The pump of claim 5 wherein the difference in diameters between the guide rods and corresponding surface areas of the pistons upon which the working fluids is in contact with in the source substance and effluent cylinders results in the pressure of working fluid in the fluid section of the effluent cylinder being substantially similar to the pressure of the working fluid in the fluid section of the input cylinder that is required to pump the source substance.

7. The pump of claim 2 wherein the input process section of the pump is configured to receive a slurry as the source substance.

8. The pump of claim 1 further comprising one or more valves to permit the selective transfer of fluid between the fluid sections of the effluent cylinder and the input cylinder.

9. A system for pumping a source substance and an effluent comprising:

a process reactor, said process reactor configured to receive a source substance as input to a process and generate an effluent as output from the process;

an input portion comprising an input cylinder having an inner diameter, an input piston positioned within said input cylinder and said input piston separating an input process section from a fluid section, and an input cylinder guide rod within the fluid section and attached to said piston, said input cylinder guide rod having a first diameter, wherein said input piston and said input cylinder guide rod are operable to pump the source substance;

an effluent portion comprising an effluent cylinder having an inner diameter, an effluent piston positioned within said effluent cylinder and said effluent piston separating an effluent process section from a fluid section, and an effluent cylinder guide rod within the fluid section attached to said effluent piston, said effluent cylinder guide rod having a second diameter that is different than the first diameter associated with said input cylinder guide rod, wherein said effluent piston and said effluent cylinder guide rod are operable to pump an effluent, wherein:

the inner diameter of said input cylinder and the inner diameter of said effluent cylinder are substantially equal and the fluid sections of each of said input cylinder and said effluent cylinder are in fluid communication with each other, and the difference between the first diameter associated with said input cylinder guide rod and the second diameter associated with said effluent cylinder guide rod is operable to compensate for a pressure difference between a pressure associated with a source substance input into said process reactor from said input cylinder and a pressure associated with an effluent contained within said process reactor and output to said effluent cylinder from said process reactor; and one or more valves to permit the selective transfer of fluid between the fluid sections of each of said input cylinder and said effluent cylinder.

10. The system of claim 9 wherein the input process section of the input portion is configured to receive a slurry as the source substance.

11. The system of claim 10 further comprising one or more valves configured to control the inlet and exhaustion of working fluid from the fluid section of said input cylinder and the fluid section of said effluent cylinder.

12. The system of claim 10 further comprising one or more valves configured to control the inlet and exhaustion of source substance from the input process section of said input cylinder.

13. The system of claim 12 further comprising one or more valves configured to control the inlet and exhaustion of effluent from the effluent process section of said effluent cylinder.

14. The system of claim 13 further comprising a heat exchanger, said heat exchanger configured to transfer heat from effluent output from said process reactor to source substance input to said process reactor.

15. The system of claim 9 further comprising one or more position-measuring mechanisms for measuring the linear displacement of said input cylinder guide rod or said effluent cylinder guide rod.

16. The system of claim 15 wherein said one or more position-measuring mechanism comprise at least one of linear variable differential transducers and string pots.

17. A method of pumping a source substance into a process reactor and receiving an effluent as output from the process reactor, the method comprising the steps of:

receiving a source substance into an input process section of an input cylinder and substantially simultaneously discharging effluent from an effluent process section of an effluent cylinder;

wherein the input process section of the input cylinder is configured to receive the source substance and an input piston separates the input process section from a fluid section configured to receive a working fluid, and wherein the effluent process section of the effluent cylinder is configured to receive the effluent discharged from the process reactor and an effluent piston separates the effluent process section from a fluid section configured to receive a working fluid, and wherein the fluid sections of the input and effluent cylinders are in fluid communication with each other;

discharging the source substance from the input process section of the input cylinder at an elevated pressure into the process reactor and substantially simultaneously receiving effluent into the effluent process section of the effluent cylinder at an elevated pressure from the process reactor, wherein working fluid is directed from the fluid section of the effluent cylinder to the fluid section of the input cylinder to act against the input piston therein and expel the source substance from the input process section, thereby reducing the amount of working fluid required to be supplied by an external source.

18. The method of claim 17 further comprising an input cylinder guide rod and an effluent cylinder guide rod, said input cylinder guide rod associated with a first diameter and said effluent cylinder guide rod associated with a second diameter, and wherein said guide rods are attached to corresponding pistons and extend through at least a portion of the respective fluid sections of the cylinders.

19. The method of claim 18 wherein the first and second diameters are operable to compensate for a pressure difference between a pressure associated with the source substance input into the process reactor from the input cylinder and a pressure associated with an effluent contained within the process reactor and output to the effluent cylinder.

20. The method of claim 18 wherein the first and second diameters are substantially equal.

21. The method of claim 17 further comprising directing the source substance through a heat exchanger after the discharging of the source substance from the input process section of the input cylinder and before the source substance enters the process reactor.

22. The method of claim 17 further comprising directing the effluent through a heat exchanger prior to receiving the effluent into the effluent process section of the effluent cylinder and after the effluent exits the process reactor.

* * * * *